United States Patent [19]

Hoeft

[11] Patent Number: 4,650,013

[45] Date of Patent: Mar. 17, 1987

[54] CHIP SAMPLER

[76] Inventor: Arthur P. Hoeft, 8754 E. Eastman Ave., Denver, Colo. 80231

[21] Appl. No.: 856,398

[22] Filed: Apr. 28, 1986

[51] Int. Cl.[4] ..... E21B 25/00

[52] U.S. Cl. ..... 175/211

[58] Field of Search ..... 175/88, 206, 207, 209, 175/210, 211, 212, 214, 244

[56] References Cited

U.S. PATENT DOCUMENTS

| | | | |
|---|---|---|---|
| 1,128,437 | 2/1915 | Galligan | 175/211 |
| 2,712,921 | 7/1955 | Redman . | |
| 2,730,333 | 1/1956 | Lenhart, Jr. et al. . | |
| 2,941,783 | 6/1960 | Stinson | 175/206 |
| 3,179,187 | 4/1965 | Sarapuu . | |
| 3,303,895 | 2/1967 | Fontenot | 175/206 |
| 3,441,097 | 4/1969 | Ahlgren et al. . | |
| 3,811,518 | 5/1974 | Kalaf et al. . | |
| 3,825,082 | 7/1974 | Woodruff | 175/212 |
| 3,841,421 | 10/1974 | Matsushita . | |
| 4,223,748 | 11/1980 | Barendsen . | |
| 4,281,724 | 8/1981 | Garrett . | |

FOREIGN PATENT DOCUMENTS

| | | | |
|---|---|---|---|
| 5914 | of 1913 | United Kingdom | 175/211 |

*Primary Examiner*—Stephen J. Novosad
*Assistant Examiner*—William P. Neuder
*Attorney, Agent, or Firm*—Henderson & Sturm

[57] ABSTRACT

A chip sampler including a sampler barrel aligned with the stern of a drill pipe to form an extended annular space to receive cuttings from a drilled hole. The sampler barrel carries a reject port in communication with the entire annular space and an access port disposed below the reject port. The access port receives a sample extractor that includes a downwardly directed nose opening which extends into a predetermined proportion of the extended annular space. A reasonably sized representative sample of the cuttings travelling up the extended annular space enter the nose opening and are received into a detachable sample container.

8 Claims, 4 Drawing Figures

CHIP SAMPLER

TECHNICAL FIELD

This invention relates to the sampling of cuttings, chips, fine dust, etc., which are carried by drilling fluids upward and out of a hole being drilled through a geologic deposit. More specifically, the invention relates to the continuous diversion of part of the steady stream of cuttings and drilling fluids emerging from the hole while being drilled.

BACKGROUND ART

The art of carrying drill cuttings away from the drill bit and up to the surface in the course of penetrating geologic deposits is well known. Drilling muds, water, compressed air and other circulating fluids are used depending on local conditions. Also well known is the art of sampling a deposit after mining by intermittently passing a container or open chute through the falling stream as it comes off the end of a conveyor belt. But the art of sampling drill cuttings as they emerge from the drilled hole is, until now, unknown.

Sampling, as the term is used in the coal industry, means to obtain a reasonable amount of material which is representative of some larger amount of that material. To be considered "reasonable", a sample must be of such weight as to be handled conveniently in the field and at the laboratory. To be considered "representative", a sample must contain proportionate amounts of all constituents found in the larger amount of material from which it was taken. In the case of coal which has been partially crushed, (such as cuttings from blast holes), it is well known that "proportionate amounts" of constituents can only be present in the sample when the size distribution of the particles in the sample is identical to the size distribution in the large amount of material from which the sample was taken. Size distribution is important because coarse coal lumps are often of substantially different quality (sulfur content, heating value, ash content, etc.) than the fine dust, even though both came from the same coal deposit. Furthermore, it is recognized by knowledgeable coal sampling personnel that sample integrity is violated when size segregation occurs, and that rehomogenization can only be accomplished through considerable effort such as lengthy blending in a suitable apparatus.

In light of the above, a blast hole cutting sample must be small enough to be easily handled, and must contain the same natural particle size distribution as the total amount of cuttings produced by drilling the hole.

With the top of the coal deposit exposed, blast hole locations are marked by any convenient method. A blast hole drill rig is positioned at the site of the first hole and begins drilling. Compressed air is forced down through a hollow pipe which has a drill bit attached to its lower end. Holes in the drill bit permit the passage of air out through the bit. Since the drill bit diameter is somewhat larger than the pipe diameter an annular space is created between the outside of the pipe and the inside of the hole. As the pipe and the drill bit are rotated in the hole, cuttings are produced and carried upward. When they reach the surface they can simply be blown out of the hole and allowed to fall wherever they might, or they can be deflected away from the hole and then blown out onto the ground, or they can be first deflected away from the hole and then some method can be employed to collect them.

Hole diameters can vary from five or six inches to nine or ten inches, and coal thicknesses can vary from five feet to over fifty feet (and occasionally 75 to 100 feet). Therefore, the total weight of cuttings from a single hole can vary from about 100 pounds to nearly a ton or more.

The number of holes in a typical blast hole pattern might be 50 to 100 at some mines and might be several hundred at others. New blast hole patterns are sometimes drilled as often as every day or sometimes only once each week. Depending on the specifics of the mining operation and the coal deposit, there can be from five to more than one hundred tons of drill cuttings produced every week.

Clearly, all the drill cuttings produced at a mine cannot practically be collected and sent to a laboratory for testing. Some type of sampling must be employed to reduce the sheer volume of material. The most common method is to blow the cuttings onto the ground, then use a shovel or some type of partitioning device to divide each pile, or some pattern of piles, into smaller portions which are then sent to the laboratory. This method has the obvious drawback of failing to include in the sample the fine dust particles which are lost to the environment during drilling. These dust particles are often of different quality from the coarse chips and can have a substantial effect on apparent overall quality. Variations of this method have been tried at almost every surface coal mine and have met with only limited success in isolated cases.

Another approach to sampling is to collect all the cuttings from a hole using either a filter type bag house or a cyclone type separation system, or some combination of these. Because of the way these devices operate, the coarse material is removed first (typically by gravity) and the fine dust is removed in a separate step. This intentional separation according to size or weight allows these systems to work very efficiently as dust collectors and air purifiers, but renders them nearly useless as sample collectors. Good sampling practice requires not only that the size distribution in the sample be the same as the material that was sampled, but also that the size distribution in the sample not be reconstructed from its separate size constituents. A further drawback of the bag house/cyclone equipment is, again, the sheer volume of cuttings since this method collects all of the material produced by drilling the hole and makes no provision for reducing the volume of sample. This method also suffers from the high initial cost of auxiliary equipment including a truck or trailer on which to mount it, and substantial maintenance costs for replacement filters, motors, fans, etc. As with the previous method, the bag house/cyclone method has been tried at a number of mines, but is not being used anywhere as a sampling procedure.

Those concerned with these and other problems recognize the need for an improved chip sampler.

DISCLOSURE OF THE INVENTION

The present invention provides a chip sampler including a sampler barrel aligned with the stem of a drill pipe to form an extended annular space to receive cuttings from a drilled hole. The sampler barrel carries a reject port in communication with the entire annular space and an access port disposed below the reject port. The access port receives a sample extractor that includes a downwardly directed nose opening which extends into a predetermined proportion of the extended annular space. A reasonably sized representative sample of the cuttings travelling up the extended annular space enter the nose opening and are received into a detachable sample container.

The unique features of the chip sampler are that it obtains about 10% of the total cuttings from the drilled hole as the sample, thereby reducing the volume of material to be handled by 90%, and that it takes both coarse chips and fine dust at the same time, thereby creating a sample with the same particle size distribution as the material being sampled. Furthermore, it is compact enough to be mounted under the drill rig thereby eliminating the need for an auxiliary truck or trailer, and it is far less costly to purchase and maintain than a bag house/cyclone system. Last, but most important, is that it works where other devices and methods do not.

An object of the present invention is the provision of an improved chip sampler.

Another object is to provide a chip sampler that obtains a reasonably sized representative sample of the drilled deposit.

A further object of the invention is the provision of a chip sampler that is compact and convenient to transport.

Still another object is to provide a chip sampler that is inexpensive to purchase and maintain.

A still further object of the present invention is the provision of a chip sampler that is convenient to use.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
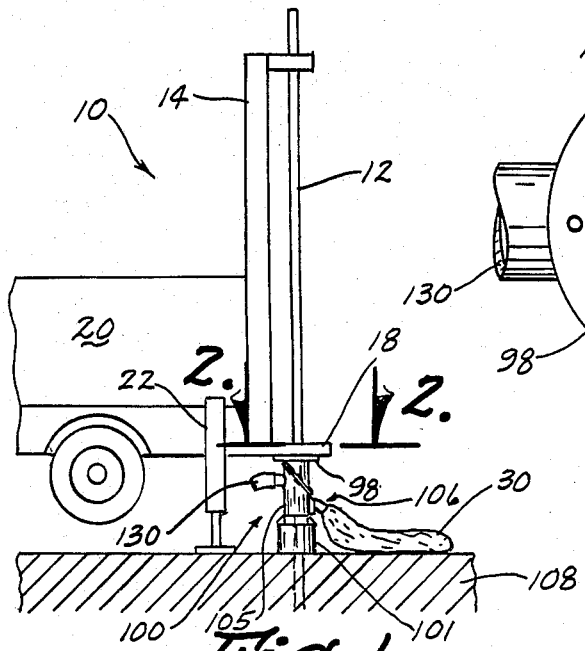
FIG. 1 is a side elevational view showing the chip sampler of the present invention attached to the underside of the floor of a conventional blast hole drilling rig.

Referring now to the drawings, wherein like reference numerals designate identical or corresponding parts throughout the several views, FIG. 1 shows a drilling rig (10) including a string of drill pipe (12) mounted to an upright (14) by conventional arrangement that provides for the rotation and downwardly axial movement of the pipe (12). The pipe (12) extends through the floor (18) that is carried on the rear of a vehicle (20). The vehicle (20) includes conventional hydraulic means (22) to raise the rear of the vehicle (20) to stabilize it during the drilling operation.

The chip sampler (100) is fastened upright by flanges (98) or any other convenient method to the bottom of the drilling rig floor (18) so that it is aligned with the stem (103) of the drill pipe (12). By using conventional rig hydraulics (22), the sampler (100) is lowered until the foam rubber boot (101) makes firm contact with the top of the material to be drilled (108).

Figure 2:
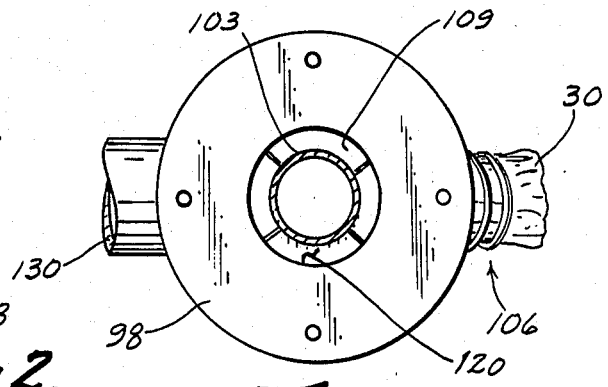
FIG. 2 is an enlarged top plan sectional view taken along line 2—2 of FIG. 1 showing the sample extractor extending into the annular space between the drill stem and the barrel of the sampler.
Figure 3:
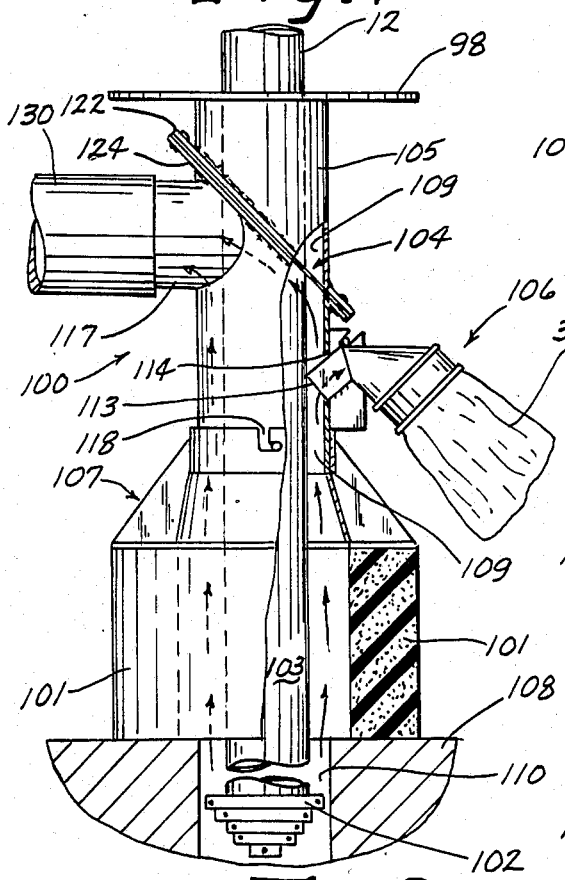
FIG. 3 is a side elevational view of the chip sampler having a portion cut away to illustrate the flow of cuttings up the extended annulus into the sample extractor.
Figure 4:
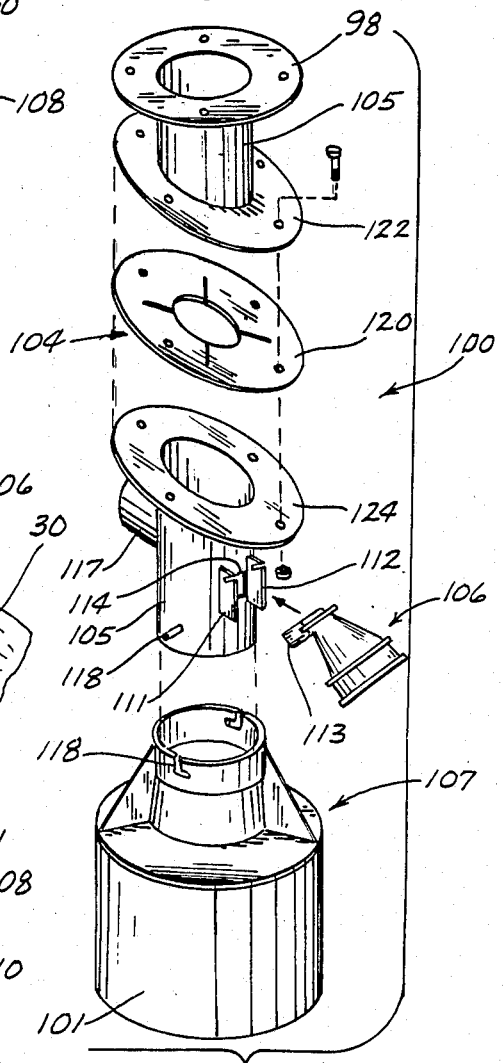
FIG. 4 is an exploded perspective view of the chip sampler.

As best shown in FIG. 2, the drill bit (102) and drill stem (103) pass vertically through the barrel of the sampler (105), through the chip deflector (104), past the reject port (117), past the sample extractor access hole (114), through the boot assembly (107), through the foam rubber boot (101) and into the geologic deposit or other material to be drilled (108). An annular space (109) is formed between the drill stem (103) and all internal walls of the sampler barrel (105). Annular space (109) is an extension of the annular space (110) normally created only in the geologic deposit (108) above the drill bit (102). The sample extractor (106) is now positioned between the two retaining flanges (111 and 112) with its open nose (113) protruding through the access hole (114) and into the extended annular space (109). The sample extractor (106) is connected to a suitable sample container such as a bag (30) made of conventional dust collection filter material.

As drilling is begun, cuttings are forced by compressed air up the annular space (110) and into the extended annular space (109). A portion of the cuttings, including fine dust particles which are aligned in the extended annular space (109) with the opening (113) in the sample extractor (106) will be extracted and deposited in the sample container (30). The remainder of the cuttings will pass by the extractor (106), impact the rubber gasket (120) held in place by the retaining flanges (122 and 124) of the chip deflector (104) and pass out of the sampler (100) through the reject port (117).

On completion of drilling, the drill stem (103) and drill bit (102) are retracted from the hole and brought up into the sampler barrel (105). The boot assembly (107) is removed by rotating the slot-and-pin mechanism (118) so that sufficient ground clearance is created, enabling the drill rig (10) to move to the location of the next hole. Before moving, the filled sample container (30) is detached and is replaced with an empty one at the next hole site.

The new and unique feature of the chip sampler (100) is the use of a sample extractor (106) with an open nose (113) protruding into an extended annular space (109) so as to occupy a predetermined percentage of the cross sectional area of the extended annular space (109) and thereby extract a proportional amount of the cuttings which are representative of all the cuttings emerging from the hole.

The relative positions of the sample extractor (106), chip deflector (104) and reject port (117) around the circumference of the sampler (100) may not always be as shown in the drawings. Their exact placements may depend on the space available and other equipment in use of the drill rig (10). Also, it is to be understood that a flexible hose (130) may be attached to the reject port (117) to direct the major fraction of the cuttings to any desired location remote from the drilling rig (10). The sampler (100) is compatible for use with most dust collection equipment. However, because it controls cuttings placement it may, in some cases, eliminate the need for costly dust suppression hardware.

Since there are no moving parts, the sampler (100) is virtually maintenance free. When the leading edge of the sample extractor (106) becomes worn, it can be quickly adjusted or replaced.

Thus, it can be seen that at least all of the stated objectives have been achieved.

Obviously, many modifications and variations of the present invention are possible in light of the above teachings. It is therefore to be understood that, within the scope of the appended claims, the invention may be practised otherwise than as specifically described.

I claim:

1. In a chip sampler to be used in conjunction with a drilling rig including a drill pipe stem and a drill bit extending radially outward from said pipe stem to form a first annular space between the pipe stem and a drilled hole, the improvement comprising:

a sampler barrel attached to said drilling rig and aligned with said drill pipe stem such that a second annular space is formed therebetween, said sampler barrel being disposed to extend between said drilling rig and said drilled hole such that said second annular space forms an extension of said first annular space;

a reject port formed in said sampler barrel in communication with said second annular space;

an access hole formed in said sampler barrel below said reject port; and a sample extractor attached to said sampler barrel and disposed to extend into said access hole between said sampler barrel and said drill pipe stem, whereby a representative sample of cuttings coming from said drilled hole enter into said sample extractor.

2. The chip sampler of claim 1 further including a chip deflector attached to said sampler barrel above said reject port, said chip deflector being disposed to fill said second annular space thereby deflecting cuttings into the reject port.

3. The chip sampler of claim 2 wherein said chip deflector is angularly disposed with respect to said sampler barrel.

4. The chip sampler of claim 1 wherein said sample extractor is releasably attached to said sampler barrel.

5. The chip sampler of claim 1 further including a foam rubber boot forming the lower end of said sampler barrel adjacent said drilled hole, thereby allowing for a sealing surface between said sampler barrel and ground adjacent said drilled hole.

6. The chip sampler of claim 5 wherein said foam rubber boot is releasably attached to the lower end of said sampler barrel.

7. The chip sampler of claim 4 wherein said sample extractor includes a horizontally disposed rod; wherein said sampler barrel carries a pair of vertically extending retaining flanges disposed adjacent said access hole, said flanges having slots formed therein; and wherein said rod selectively engages said slots to releasably secure said sample extractor to said sampler barrel.

8. The chip sampler of claim 1 wherein said sample extractor includes a downwardly directed nose opening disposed within said second annular space.

* * * * *